US005851105A

United States Patent [19]

Fric et al.

[11] Patent Number: 5,851,105

[45] **Date of Patent: *Dec. 22, 1998**

[54] TAPERED STRUT FRAME

[75] Inventors: Thomas Frank Fric, Schenectady; Michael Lewis James, Charlton, both of N.Y.

[73] Assignee: General Electric Company, Schenectady, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 837,031

[22] Filed: Apr. 11, 1997

Related U.S. Application Data

[63] Continuation of Ser. No. 496,144, Jun. 28, 1995, abandoned.

[51] Int. Cl.[6] ..... F04D 29/44

[52] U.S. Cl. ..... 415/208.1; 415/914

[58] Field of Search ..... 415/208.1, 209.1, 415/209.2, 209.3, 209.4, 210.1, 914

[56] References Cited

U.S. PATENT DOCUMENTS

| | | | |
|---|---|---|---|
| 2,798,661 | 7/1957 | Willenbrock, Jr. et al. | 415/210.1 |
| 3,957,402 | 5/1976 | Sloan | 415/142 |
| 4,452,564 | 6/1984 | Conant et al. | 415/210.1 |
| 4,780,052 | 10/1988 | Pradelle | 415/210.1 X |
| 4,987,736 | 1/1991 | Ciokajlo et al. . | |
| 5,249,927 | 10/1993 | Vera | 415/914 |
| 5,301,500 | 4/1994 | Hines . | |
| 5,312,227 | 5/1994 | Grateau et al. | 415/210.1 X |
| 5,346,365 | 9/1994 | Matyscak | 415/209.4 X |
| 5,356,264 | 10/1994 | Watson et al. | 415/119 X |
| 5,474,419 | 12/1995 | Reluzco et al. | 415/210.1 |

FOREIGN PATENT DOCUMENTS

| | | | |
|---|---|---|---|
| 2386706 | 11/1978 | France | 415/914 |
| 682674 | 8/1979 | U.S.S.R. | 415/914 |
| 697748 | 9/1953 | United Kingdom | 415/914 |
| 985776 | 3/1965 | United Kingdom | 415/914 |

OTHER PUBLICATIONS

"On the Wake and Drag of Bluff Bodies", by A. Roshko, Journal of Aeronautical Sciences, Feb. 1995, pp. 124–132.

"An Experimental Study of Airfoil–Spoiler Aerodynamics", by McLachlan and Karamcheti, NASA Contractor Report 177328, pp. Cover, Table of Contents, vii, ix, xi, 1–85 odd, 86, 88.

"A Method of Reducing Drag and Fluctuating Side Force on Bluff Bodies", by LeSage and Gartshore, Journal of Wind Engineering and Industrial Aerodynamics, vol. 25, 1987, pp. 229–245.

*Primary Examiner*—John T. Kwon

*Attorney, Agent, or Firm*—Patrick K. Patnode; Marvin Snyder

[57] ABSTRACT

A strut bridges inner and outer walls of a frame defining a flow channel for channeling a fluid therethrough. The strut has leading and trailing edges, and a root and tip, and is tapered between the root and tip for varying frequency and amplitude of vortex shedding.

10 Claims, 3 Drawing Sheets fig. 1
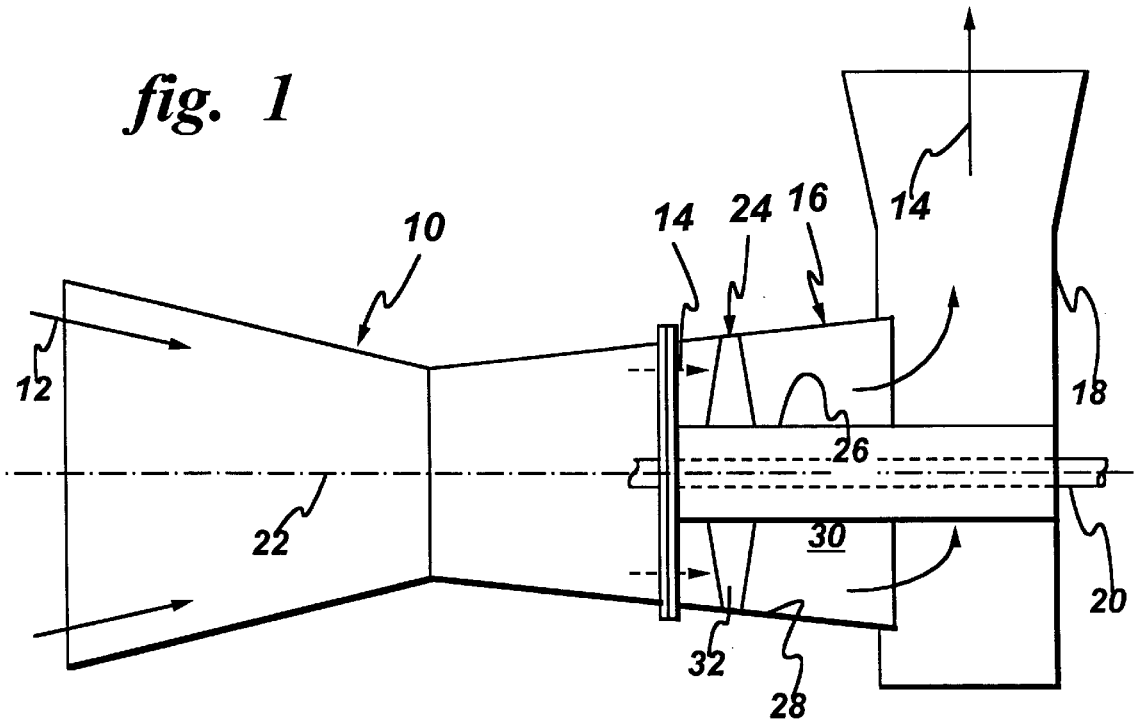
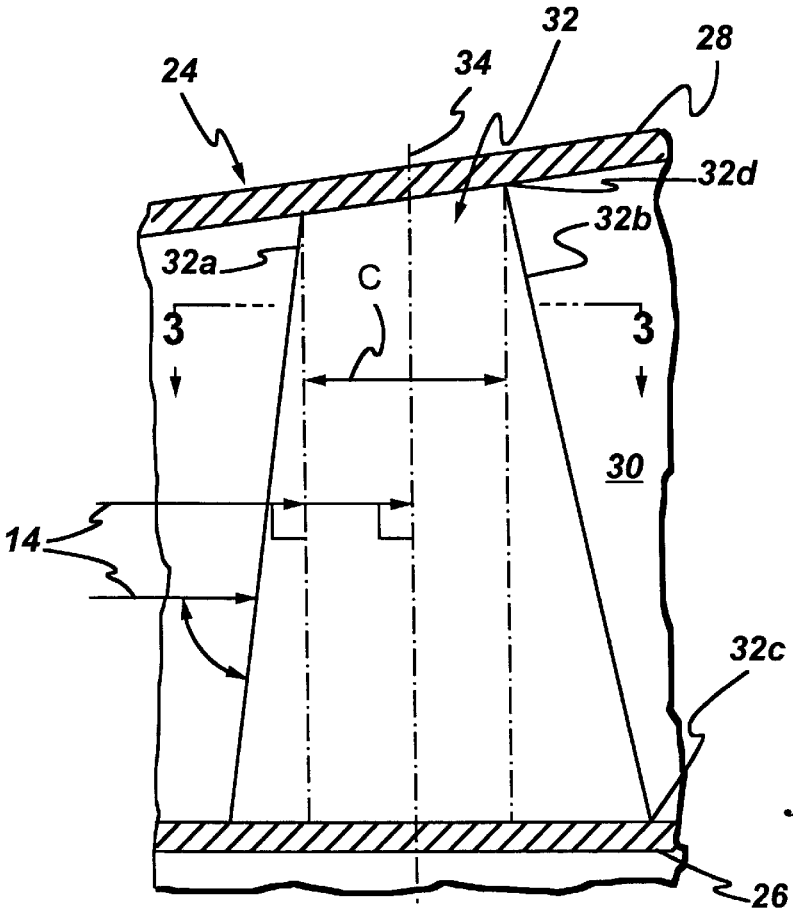
fig. 2

TAPERED STRUT FRAME

This application is a continuation of application Ser. No. 08/496,144 filed Jun. 28, 1995, now abandoned.

BACKGROUND OF THE INVENTION

The present invention relates generally to bluff bodies and vortex shedding therefrom, and, more specifically, to passive control of aerodynamic vortex shedding.

An aerodynamic bluff body may be in the exemplary form of a streamlined strut, airfoil, or cylinder. A strut, for example, is typically configured and oriented in a flow channel so that when subjected to a desired angle of attack or swirl angle of the incident fluid flow, the body presents minimum drag and adverse effects. A typical strut is found in an aerodynamic frame for supporting outer and inner walls defining therebetween a flow channel. The strut is typically symmetrical or slightly curved in camber with a relatively long chord-to-thickness ratio to provide minimum blockage to the fluid at a nominal or minimum angle of attack which is generally parallel to the outer surfaces of the strut.

A typical airfoil has more camber or curvature to intentionally create opposite pressure and suction sides to perform work. A compressor airfoil imparts energy into the fluid for compressing the flow, and a turbine airfoil extracts energy from the fluid for rotating a drive shaft.

In both the strut and the airfoil modification thereof, the fluid flow has a nominal angle of attack predetermined to minimize drag without lift in the former case and with lift in the latter case. However, if the angle of attack changes from the desired value, the relatively wide strut and airfoil effect bluff bodies having a substantial increase in drag, and from which vortex shedding occurs creating sideways extending wakes. Such wakes may be unsteady and create flow induced forces, vibration, and associated noise which are undesirable. The induced forces and vibration can lead to structural fatigue failure reducing the useful lifetime of the struts and/or adjacent components. In the example of an axisymmetrical cylindrical rod, the angle of attack is not relevant, however vortices are nevertheless shed, with the attendant problems associated therewith.

The prior art has attempted to control vortex shedding from bluff bodies by providing additional components such as spoiler plates or vortex generators with varying degrees of success and complexity.

SUMMARY OF THE INVENTION

A strut bridges inner and outer walls of a frame defining a flow channel for channeling a fluid therethrough. The strut has leading and trailing edges, and a root and tip, and is tapered between the root and tip for varying vortex shedding.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which:

FIG. 1 is a schematic representation of an exemplary industrial gas turbine engine having a diffuser including tapered struts in accordance with an exemplary embodiment of the present invention.

FIG. 2 is an elevational, side view of one of the several circumferentially spaced apart struts illustrated in the diffuser of FIG. 1.

DESCRIPTION OF THE PREFERRED EMBODIMENT(S)

Figure 3:
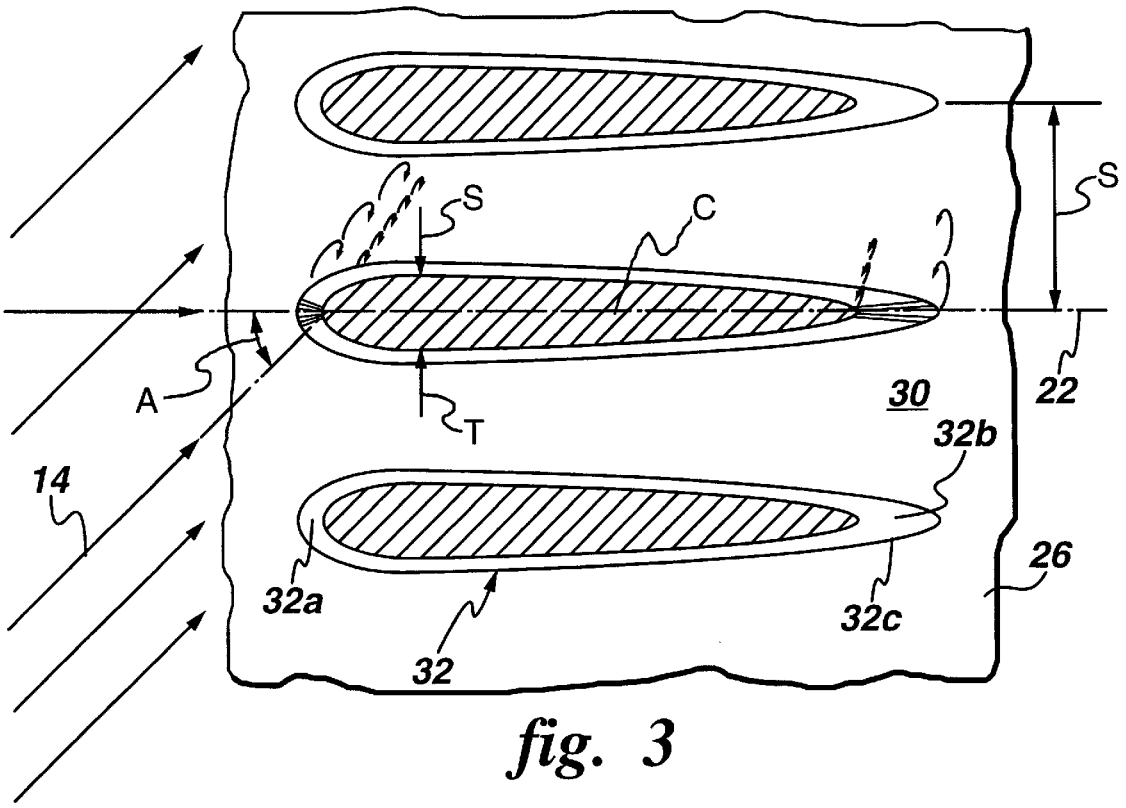
FIG. 3 is a top, partly sectional view through adjacent struts of the diffuser illustrated in FIG. 2 and taken along line 3—3.

Illustrated schematically in FIG. 1 is an exemplary industrial gas turbine engine 10 which is conventionally configured for receiving ambient air 12 and discharging exhaust or combustion gases 14 into an annular diffuser 16, which are then discharged to the atmosphere through a conventional exhaust assembly 18.

The engine 10 may take any conventional form including single or dual rotor engines, with one or more compressors therein, followed in turn by a combustor (not shown) in which compressed air is mixed with fuel and ignited for generating the combustion or exhaust gases 14. Disposed downstream of the combustor are one or more turbine stages (not shown) which extract energy from the exhaust gases 14 for powering the engine 10 as well as typically providing output power through an output shaft 20. The engine 10 and the diffuser 16 are typically axisymmetrical about an axial centerline axis 22.

The diffuser 16 illustrated in FIG. 1 includes at its upstream end an annular frame 24 having an annular inner wall or hub 26 spaced radially inwardly from an annular outer wall or casing 28 which define radially therebetween an annular flow channel 30 for channeling a fluid, which in this case is the exhaust gases 14 therethrough. The inner and outer walls 26, 28 convention ally diverge to effect diffusion of the exhaust gases 14 to conventionally decrease the velocity thereof while increasing the pressure prior to being discharged into the exhaust assembly 18 and then in turn to the atmosphere. The frame 24 further includes a plurality of circumferentially spaced apart and aligned, radially extending struts 32 disposed at the upstream end of the channel 30. The struts 32 are configured in accordance with an exemplary embodiment of the present invention to control vortex shedding thereof during operation.

The struts 32 are illustrated in more particularity in FIGS. 2 and 3 in accordance with an exemplary configuration and embodiment thereof for reducing amplitude or pressure of wakes W shed from the struts 32 during certain modes of operation of the engine 10. A typical prior art strut is uniform in cross section from its root to tip. In accordance with the present invention, the struts 32 are tapered along their span or longitudinal axis 34 as best shown in FIG. 2 to vary the length C of the chord between leading and trailing edges 32*a* and 32*b*, which in turn varies vortex shedding of the exhaust gases 14 from the struts 32. Each of the struts 32 bridges the inner and outer walls 26, 28 and includes a radially inner root 32*c* suitably fixedly joined to the inner wall 26, and a radially outer tip 32*d* fixedly joined to the outer wall 28.

FIG. 3 illustrates one exemplary configuration of the cross section of the struts 32 which is streamlined in a generally symmetrical teardrop configuration between the leading and trailing edges 32*a* and 32*b* for providing a minimum frontal contour or area to minimize drag resistance upon flow of the exhaust gases 14 at a minimum angle of attack or swirl angle A relative to the leading edge 32*a*. At any radial section of the strut 32, a conventional straight chord is defined between the leading and trailing edges 32*a,b* and is represented by its length C. The swirl angle A is a conventional parameter typically measured relative to the mean camber line, which in this exemplary embodiment is also the chord.

As shown in FIG. 3, each of the radial sections of the struts 32 also has a maximum thickness T measured in the circumferential direction which is generally perpendicular to the chord. In a typical design, the thickness T is substantially less than the chord length C to minimize flow blockage at the nominal or minimum swirl angle A having typically a zero value. In this way, exhaust gases 14 are channeled generally parallel over both lateral surfaces of the struts 32 from the leading to trailing edges 32*a* and 32*b*.

The industrial engine 10 is typically operated at a single design speed associated with producing a substantially maximum power output for driving a base load such as a generator (not shown) attached to the output shaft 20. The engine 10 is typically operated substantially continuously at the base load speed, with the struts 32 being fixed at a single position with a minimum swirl angle for providing maximum efficiency of operation of the engine 10.

Conversely, during non-base load operation of the engine 10, at reduced or part power of operation for example, the swirl angle A of the exhaust gases 14 discharged from the engine 10 into the diffuser 16 have a greater than minimum value up to about 55° for example. When this occurs as shown in FIG. 3, the sides of the struts 32 are directly exposed to the high-swirl angle gases 14 and create bluff bodies from which vortices are shed sideways from the struts 32 creating the wakes W. For a prior art uniform strut, a single dominant wake shedding mode is created at a specific frequency which can lead to undesirable unsteady wakes, flow-induced forces, vibration, and associated noise.

However, in accordance with the present invention, by tapering the struts 32, the side contour of each of the struts 32 varies in the spanwise direction so that vortices are shed from the leading and trailing edges 32*a* and 32*b* at varying or different frequencies and amplitudes along the span or taper. In this way, a single dominant vortex shedding frequency is reduced or eliminated, with an attendant reduction in flow-induced forces, vibration and associated noise. In the diffuser embodiment illustrated in FIG. 3, the struts 32 are circumferentially spaced apart from each other at a relatively close spacing S which is about the mid-span or pitch chord length C so that vortices shed from one strut 32 impinge an adjacent strut 32 at the relatively high or maximum swirl angle. By tapering the struts 32, the adverse vibratory excitation effects of the wakes W on the adjacent struts 32 are reduced.

Tapering the struts 32 allows for larger swirl angles A or a greater range between the minimum and maximum values thereof without undesirable wake generation therefrom. Since each of the struts 32 projects or effects a larger bluff side contour or area between the leading and trailing edges 32*a,b* as opposed to the relatively small or minimum frontal contour of each strut 32 at the leading edge 32*a*, tapering of the strut 32 may be accomplished at solely the leading edge 32*a*; at solely the trailing edge 32*b*; or at both the leading and trailing edges 32*a* and 32*b* as desired. In this way, the bluff side contour of the struts 32 may be readily altered in the span direction to vary the frequency and amplitude of vortex shedding.

More specifically, and referring to FIG. 2, the bluff side contour of one of the struts 32 is illustrated in elevation. Each of the struts 32 has a respective longitudinal or span axis 34 extending between the root 32*c* and the tip 32*d*, and in this exemplary embodiment is disposed substantially perpendicular to the direction of travel of the exhaust gases 14 in the axial direction. At least one of the leading and trailing edges 32*a* and 32*b* is inclined relative to the longitudinal axis 34, or is non-parallel the FIG. 2 embodiment, both the leading edge 32*a* and trailing edge 32*b* are each inclined relative to the longitudinal axis 34 and converge together from the root 32*c* to the tip 32*b*, with the former being larger than the latter. Also in this exemplary embodiment, the tapering inclination of the leading and trailing edges 32*a* and 32*b* is linear, although in alternate embodiments it may be non-linear and extend for only a part of the strut span as desired. The struts 32 in the exemplary embodiment illustrated in FIG. 2 therefore decrease in taper radially outwardly with the roots 32*c* being larger than the tips 32*d*.

Taper of the strut 32 may be represented by the maximum increase in chord length C relative to the smallest chord length, which is at the tip 32*d* in the FIG. 2 embodiment. The taper may be defined at either the leading or trailing edges 32*a,b* based on the percentage increase in length over the smallest chord length C. In one embodiment tested, the leading edge 32*a* had a taper of about 25% or 1.25×, indicating a 25% increase in chord length at the root 32*c* compared to the tip 32*d*. In the same tested design, the trailing edge 32*d* had a 40% chord taper or 1.4×. A 1.5× trailing edge taper strut was also tested. A pressure amplitude frequency spectrum from a scale model diffuser tested showed a substantial reduction in unsteady pressure amplitude as well as a change in pressure frequency for the maximum amplitude of these two tested struts relative to a baseline design having a uniform strut.

Figure 4:
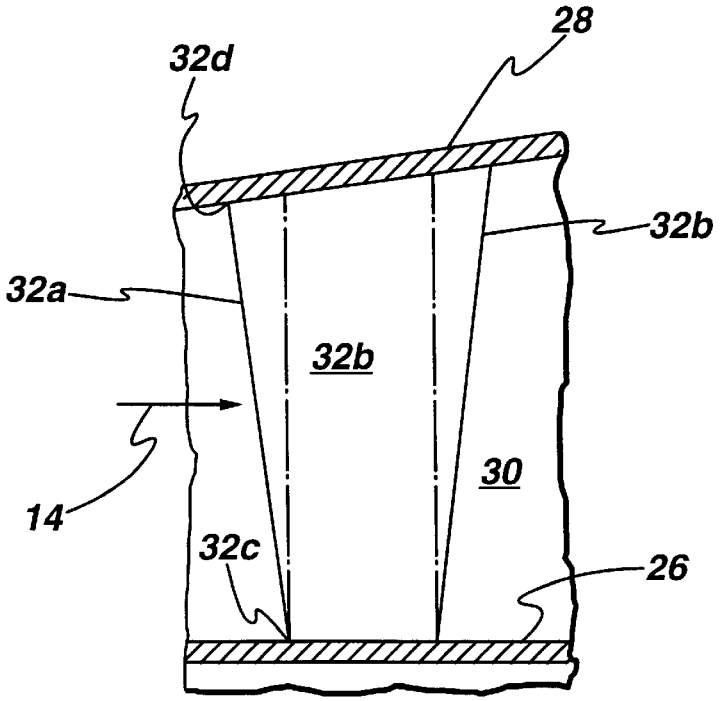
FIG. 4 is an elevational side view similar to FIG. 2 illustrating a strut in accordance with another embodiment of the present invention.

FIG. 4 illustrates an alternate embodiment generally similar to the embodiment illustrated in FIG. 2 except however that the struts designated 32B increase in taper radially outwardly, with the tips 32*d* being larger than the roots 32*c*.

Figure 5:
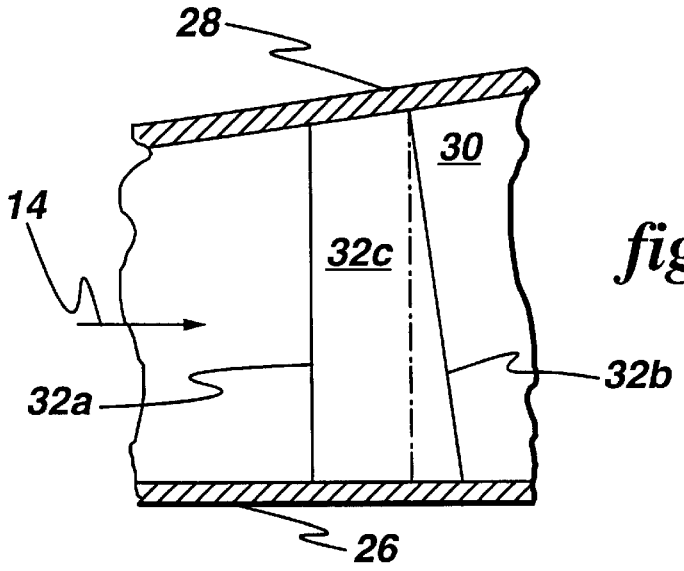
FIG. 5 is an elevational side view similar to FIG. 2 illustrating a strut in accordance with another embodiment of the present invention.

FIG. 5 illustrates yet another embodiment of struts designated 32C which are tapered solely along the trailing edge 32*b*, with the trailing edge 32*b* being inclined relative to the longitudinal axis 34, and with the leading edge 32*a* remaining parallel to the longitudinal axis 34 and non-tapered.

Figure 6:
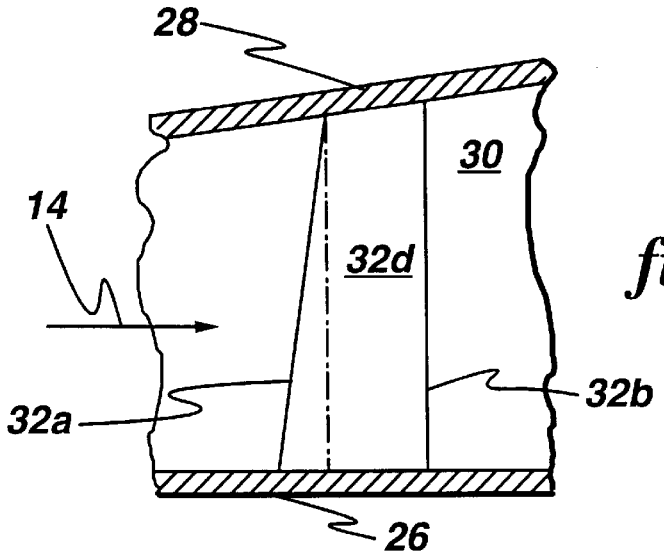
FIG. 6 is an elevational side view similar to FIG. 2 illustrating a strut in accordance with another embodiment of the present invention.

FIG. 6 illustrates yet another embodiment of the struts designated 32D which are tapered solely along the leading edge 32*a*, with only the leading edge 32*a* being inclined relative to the longitudinal axis 34, and with the trailing edge 32*b* remaining parallel to the longitudinal axis 34 and non-tapered.

The tapered trailing edge design illustrated in FIG. 5 was also tested in a scale model with a 50%, or 1.5× taper from the root to the tip. This design also showed a substantial reduction in amplitude spectrum for unsteady pressure in the vicinity of the struts over a uniform chord baseline strut design. The frequency of the maximum amplitude also was increased relative to the baseline design.

Additional component tests were conducted for three adjacent struts having tapered trailing edges of 1.25×, 1.38×, and 1.5× showing the trend of reduction in dynamic pressure amplitude as well as an increase in the frequency associated therewith as the trailing edge taper increased from 1.25× to 1.38× to 1.5×.

FIGS. 2–6 illustrate various embodiments of the struts for differently effecting taper for reducing or eliminating a single dominant wake shedding mode and replacing it with multispectrum vortex shedding modes for reducing unsteady wakes, flow-induced forces, vibration, and associated noise. This method of wake control is passive and reduces or eliminates dominant vortex shedding, changes the frequency of vortex shedding, and/or eliminates all strong vortex shedding frequencies. The specific implementation of the tapered struts can be optimized for each design application using only leading edge taper, only trailing edge taper, or a combination of both as desired. The inclination angle in the radial direction, being either forward or aft, may also be optimized for given design applications.

The specific configuration of the struts themselves may also vary as desired from the relatively streamlined configuration illustrated in FIG. 3 to alternate embodiments which act as aerodynamic bluff bodies.

Figure 7:
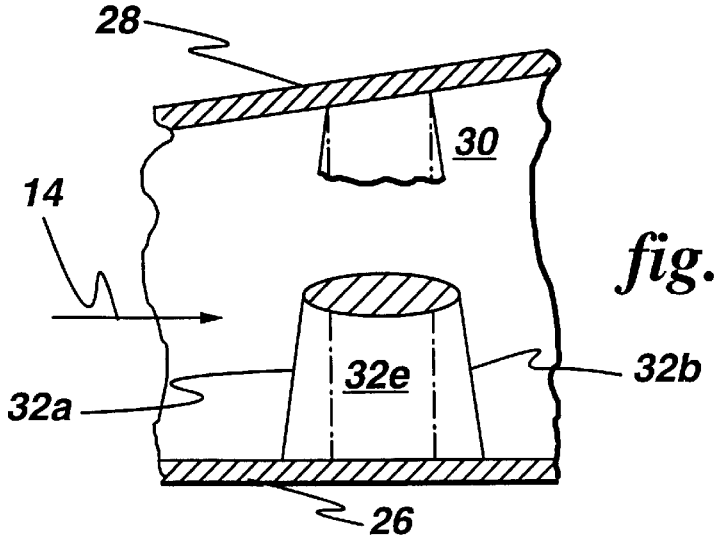
FIG. 7 is an elevational side view similar to FIG. 2 illustrating a strut in accordance with another embodiment of the present invention.

For example, FIG. 7 illustrates yet another embodiment of struts designated 32E which are circular in cross section, with tapering thereof effecting a truncated cone. Since the struts 32E are axisymmetrical, the angle of attack A is less significant except for the interaction of the adjacent struts 32E in the circumferential direction. The tapered struts 32E nevertheless are effective for generating the multispectrum vortex shedding to prevent generation of a single dominant mode wake.

The various struts described above may be used to eliminate strong vortex shedding over a wide range of flow angle of attack from 0 and up to about 90°, and do not require any additional objects in the flowpath to do so. The strut designs also do not add pressure losses at angles of attack near 0° since they continue to provide their minimum frontal area as opposed to the typically larger side area thereof. In the exemplary application of the exhaust diffuser 16, the struts may be designed to maintain substantially identical blockage and pressure losses comparable to the original baseline strut designs since the tapering is effected in the axial direction generally parallel to the angle of attack associated with baseload operation of the engine 10.

The improved tapered strut in accordance with the present invention may have various alternative configurations and may be used in embodiments other than the exemplary diffuser 16 illustrated.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

What is claimed is:

1. A frame comprising:

an inner wall;

an outer wall spaced from said inner wall to define a flow channel therebetween for channeling a fluid; and a plurality of struts having a circular cross section disposed in said channel and having roots and tips at opposite span wise ends thereof fixedly joined to said inner and outer walls, respectively, and having leading and trailing edges defining a chord therebetween and said struts being longitudinally tapered effecting a truncated cone to vary said chord in length between said roots and said tips to vary vortex shedding of said fluid from said struts, said struts each having a respective longitudinal axis extending between said root and said trip.

2. A frame according to claim 1 wherein each of said struts is tapered relative to said longitudinal axis at said leading edge and said trailing edge is parallel to said longitudinal axis and non-tapered.

3. A frame according to claim 1 wherein each of said struts is tapered relative to said longitudinal axis at said trailing edge and said leading edge is parallel to said longitudinal axis and non-tapered.

4. A frame according to claim 1 wherein each of said struts is tapered relative to said longitudinal axis at both said leading and trailing edges.

5. A frame according to claim 1 wherein each of said respective longitudinal axes extending between said root and said tip is disposed substantially perpendicularly to a direction of travel of said fluid and at least one of said leading and trailing edges is inclined relative to said longitudinal axis to effect said strut taper.

6. A frame according to claim 1 wherein said leading edge is inclined relative to said longitudinal axis.

7. A frame according to claim 1 wherein said trailing edge is inclined relative to said longitudinal axis.

8. A frame according to claim 1 wherein each of said struts extend radially outwardly from said inner wall to said outer wall.

9. A frame in accordance with claim 1 wherein said leading edge of said struts has an increase in chord length at said root that is in the range between about 1 to about 1.25 times the increase in chord length at said tip to provide vortex shedding of fluid passing thereover.

10. A frame in accordance with claim 1 wherein said trailing edge of said struts is tapered relative to a longitudinal axis between said root and said tip, where said trailing edge has an increase in chord length at said root that is in the range between about 1 to about 1.5 times the increase in chord length at said tip to provide vortex shedding of fluid passing thereover.

* * * * *